US006715996B2

(12) United States Patent
Moeller

(10) Patent No.: US 6,715,996 B2
(45) Date of Patent: Apr. 6, 2004

(54) METHOD FOR THE OPERATION OF A CENTRIFUGAL PUMP

(75) Inventor: Eik Sefeldt Moeller, Soenderborg (DK)

(73) Assignee: Danfoss Drives A/S (DK)

( * ) Notice: Subject to any disclaimer, the term of this patent is extended or adjusted under 35 U.S.C. 154(b) by 51 days.

(21) Appl. No.: 10/098,787

(22) Filed: Mar. 13, 2002

(65) Prior Publication Data

US 2002/0176783 A1 Nov. 28, 2002

(30) Foreign Application Priority Data

Apr. 2, 2001 (DE) ..... 101 16 339

(51) Int. Cl.[7] ..... F04B 49/06

(52) U.S. Cl. ..... 417/44.11; 417/44.1; 417/43; 417/53; 417/423.1

(58) Field of Search ..... 417/43, 44.1, 44.11, 417/53, 423.1

(56) References Cited

U.S. PATENT DOCUMENTS

| | | | | |
|---|---|---|---|---|
| 5,545,012 A | * | 8/1996 | Anastos et al. | 417/44.11 |
| 5,549,456 A | * | 8/1996 | Burrill et al. | 417/12 |
| 6,174,136 B1 | * | 1/2001 | Kilayko et al. | 417/44.11 |
| 6,354,805 B1 | * | 3/2002 | Moller | 417/44.1 |

FOREIGN PATENT DOCUMENTS

| | | |
|---|---|---|
| DE | 44 23 736 A1 | 1/1995 |
| DE | 196 30 384 A1 | 4/1998 |
| DE | 199 31 961 A1 | 2/2001 |
| EP | 0 696 842 A1 | 2/1996 |

* cited by examiner

*Primary Examiner*—Justine R. Yu
*Assistant Examiner*—William H. Rodriguez
(74) *Attorney, Agent, or Firm*—Altera Law Group LLC

(57) ABSTRACT

A method for the operation of a centrifugal pump (2) driven by an electric motor (5) with variable frequency, wherein too small a flow through the pump (2) is ascertained by monitoring electrical quantities, and a pump arrangement (1) having a centrifugal pump (2), an electric motor (5) which drives the centrifugal pump (2), a controlled frequency converter (6) which feeds the electric motor (5), a sensor device (12, 13) and an evaluating device (15–19) are described.

It is desired to detect, by simple means, when no through-flow is present.

For that purpose, the electrical power is ascertained and compared to a control quantity formed as a function of the frequency of the motor (5). The sensor device ascertains values for determination of the electrical power, and the evaluating device has a dynamic limit value former (18), which forms a control quantity as a function of the frequency of the motor (5).

12 Claims, 2 Drawing Sheets

METHOD FOR THE OPERATION OF A CENTRIFUGAL PUMP

The invention relates to a method for the operation of a centrifugal pump driven by an electric motor with variable frequency, wherein too small a flow through the pump is ascertained by monitoring electrical quantities.

Such a method is known from EP 0 696 842 A1. In that method, a standard frequency-voltage relationship is monitored in use. A current in the intermediate circuit is also monitored. When it is found that the value of the current is smaller than that which should be expected for the normal frequency-voltage ratio, it is assumed that the pump is operating without a load. In such a case the inverter is switched off and the motor stopped.

The electric motor of a pump of that kind is normally also cooled by the fluid being pumped. Consequently, protective measures have to be taken to prevent the pump from being destroyed when there is no through-flow. Such a situation may arise, for example, when the inflow pipe is blocked or when a valve therein has been closed in error. In such a case, the liquid remaining in place is heated, possibly to boiling point, and the pump or parts thereof and adjacent pipes can be destroyed as a result of the temperature or pressure surges.

Sensors in the pipes or reservoirs are often used to determine whether or not there is sufficient fluid present. Such sensors operate by optical means or are in the form of mechanical floats, but in all cases they are susceptible to malfunction and require a certain amount of maintenance.

In the known case, therefore, the current was used as an electrical quantity for the purpose of determining whether there exists a condition in which there is no through-flow. The control or monitoring fulfils its function, but only in a relatively narrowly circumscribed range of operation.

The problem underlying the invention is to detect, by simple means, when there is no through-flow present.

The problem is solved in a method of the kind described at the beginning by ascertaining the electrical power and comparing it to a control quantity formed as a function of the frequency of the motor.

This approach is no longer dependent upon a fixed threshold or limit value which, if it is not met, initiates a routine leading, finally, to the pump motor being stopped. Instead, the threshold value is modified dynamically in accordance with the operating frequency of the motor. By that means, it is possible to detect whether or not through-flow is present with significantly greater accuracy and irrespective of whether the motor is being operated at its nominal operating point or of whether its speed of rotation differs therefrom. The method is therefore especially suitable for centrifugal pumps that operate over a wide speed-of-rotation range, for example for the purpose of regulating the pumping rate, as is disclosed in DE 199 31 961 A1. The invention is based on the fact that the power consumption of a centrifugal pump decreases along with a decrease in the through-flow. When such characteristics are plotted with the motor frequency as a parameter in a power/through-flow diagram, a clear connection between through-flow and power is obtained in the region of relatively small amounts of through-flow.

The control quantity is preferably ascertained with the aid of a reference power that applies at a predetermined reference frequency. The predetermined reference frequency can be taken, for example, from the data sheet for the pump. The data sheet will normally show—for a specific reference frequency—the power that has to be consumed in order to drive the pump even without any through-flow. If, however, the actual motor frequency differs from the reference frequency, it is not possible for the electrical motor power to be compared to a reference value directly. The reference power is therefore converted as a function of the actual frequency and the reference frequency so that the corresponding control quantity, which can be used for the comparison, can be obtained.

The control quantity preferably includes a product, one of the factors of which can be specified by a user. As a result, due account is taken of the fact that different users require different approaches to critical situations. Users having a higher safety requirement will select a factor that is correspondingly higher. In that case, a case of malfunction will be indicated, and/or a malfunction treatment routine will be initiated, together with stopping of the motor, even when there is still a small through-flow present. Other users who are more accepting of risk can approach the loading limit for the motor and then in fact stop the motor only when there is no longer any through-flow at all. Freedom of choice is provided by the simple means of using that factor.

Special preference is given therein to selection of a factor that is greater than unity. In that, it is assumed that the actual power basically cannot be less than the motor's theoretically smallest power. Consequently, specifying that the control quantity is always formed using a factor that is greater than unity makes it possible always to remain on the safe side and rules out the possibility of errors by the user.

In an advantageous embodiment, at least two measurements of the power of the motor are made at different frequencies and without flow through the centrifugal pump, and a basis for the control quantity is ascertained therefrom. This approach is not dependent even on knowing the nominal output of the motor at nominal frequency. In contrast, however, it does becomes possible, with this approach, to take further losses into account, for example those that can occur in an inverter feeding the electric motor with variable frequency.

In this case, special preference is given to ascertaining the basis in accordance with the following formula:

$$G_{fix} = \frac{G_{f_2} - G_{f_1}\left(\frac{f_2}{f_1}\right)^3}{1 - \left(\frac{f_2}{f_1}\right)^3}$$

wherein $G_{fix}$: fixed power loss $f_1$: first frequency $f_2$: second frequency $G_{f1}$: electrical power of the motor at frequency $f_1$ $G_{f2}$: electrical power of the motor at frequency $f_2$.

This approach takes into account electrical power from effects which do not directly find expression in the delivery power of the pump. Determination of the control quantity becomes significantly more accurate using a power value of that kind.

The control quantity is preferably determined in accordance with the following relationship:

$$G_x = \left[(G_{f_1} - G_{fix}) \times \left(\frac{f_x}{f_1}\right)^3 + G_{fix}\right] \times F$$

wherein $f_x$: actual frequency $G_x$: control quantity

F: factor and the other quantities are as indicated above. It will be recognized that the control quantity is determined as a function of the frequency, with electrical powers (losses) not attributable directly to the delivery power of the pump additionally being taken into account.

The invention relates also to a pump arrangement having a centrifugal pump, an electric motor which drives the centrifugal pump, a controlled frequency converter which feeds the electric motor, a sensor device and an evaluating device.

In this pump arrangement the problem described above is solved by means of the fact that the sensor device ascertains values for determination of the electrical power, and the evaluating device has a dynamic limit value former, which forms a control quantity as a function of the frequency of the motor.

By means of a pump arrangement of this kind it is possible, by relatively simple means, to carry out monitoring of through-flow or absence of through-flow without having to accept major uncertainties if the motor operating frequency differs from a reference frequency.

The invention is described below with reference to a preferred exemplary embodiment in conjunction with a drawing, wherein.

Figure 1:
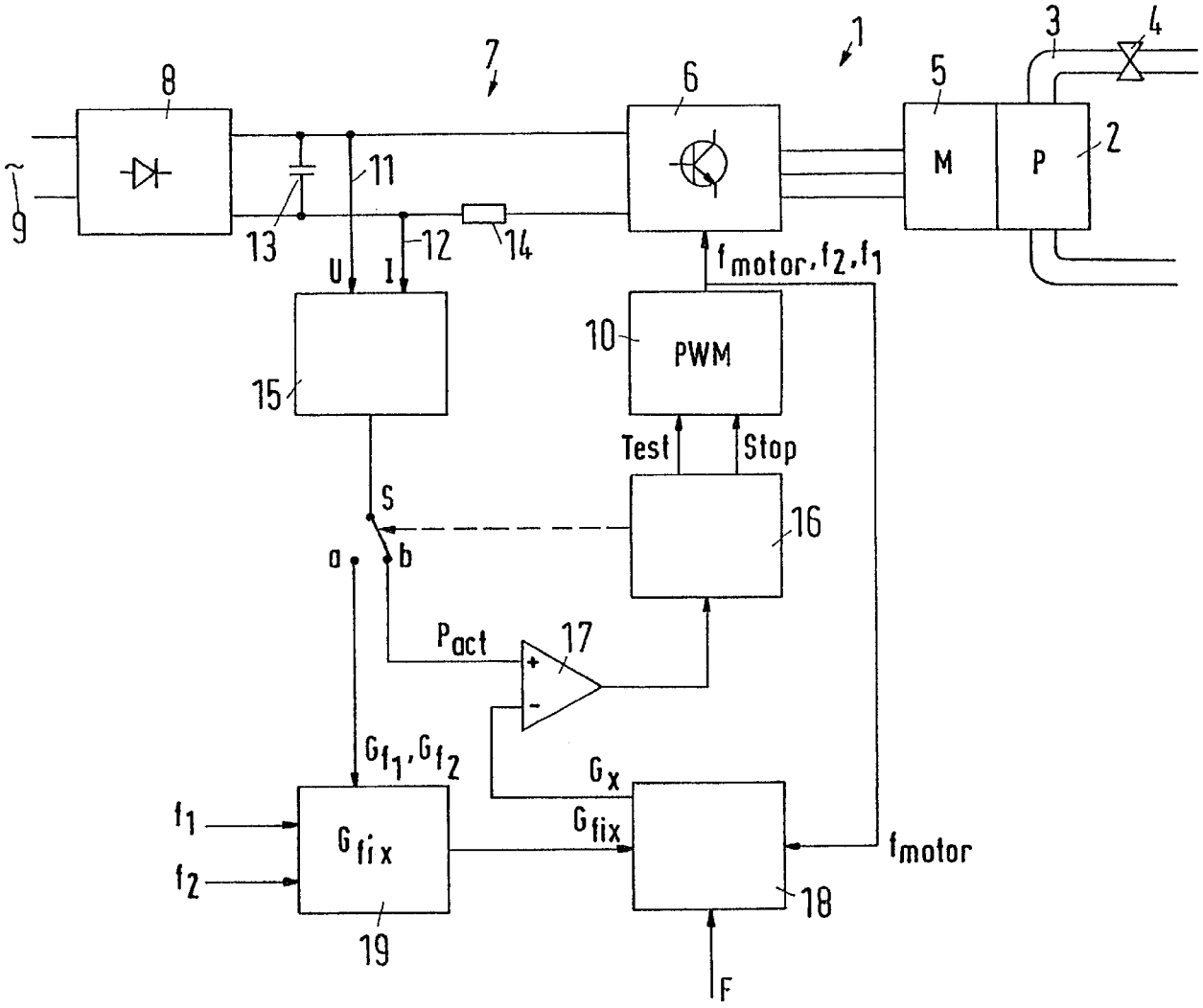
FIG. 1 shows a first embodiment of a pump arrangement.

FIG. 1 shows a pump arrangement 1 having a centrifugal pump 2, which pumps a fluid, for example water, through a pipe system 3, an inflow pipe and an outflow pipe of which are shown. Arranged in the inflow pipe is a valve 4, by means of which it is possible, as described in greater detail hereinbelow, to produce an operating condition wherein flow through the pump 2 is interrupted.

The centrifugal pump 2 is driven by a motor 5 or, more precisely, an electric motor, preferably an induction motor, such as an asynchronous machine. The motor 5 has a polyphase supply, in the present case a three-phase supply, from a converter 6, which for its part is fed by way of a direct-current intermediate circuit 7. The direct-current intermediate circuit 7 can obtain its electrical power from a rectifier 8 supplied from mains 9. However, it is, in principle, also possible for a different source of direct current, for example a battery, to be provided instead of the rectifier 8.

The converter 6 is controlled, using pulse-width modulation, by a control device 10. Such an arrangement having a PWM-controlled converter 6 for feeding an electric motor 5 is generally known.

In the direct-current intermediate circuit 7, there are provided a voltage sensor 11 and a current sensor 12, which are symbolized by arrows. For example, the voltage sensor 11 ascertains a voltage by means of an intermediate circuit capacitor 13 while the current sensor determines a voltage drop across an intermediate circuit resistor 14. The intermediate circuit current 1 and the intermediate circuit voltage U are fed to a power ascertaining device 15, which ascertains the electrical drive power of the motor 5 from the voltage U and the current 1. In actual fact, a slightly larger power is ascertained because the power ascertained in that manner also includes power losses of the converter 6 and of the motor 5.

The arrangement is shown in merely diagrammatic form. Other possibilities for ascertaining the power are, of course, also feasible.

A switch S is provided for the purpose of switching over between operation as shown, wherein the power ascertaining device 15 is connected to contact b, and test operation, wherein the power ascertaining device 15 is connected to contact a. Switching-over is carried out under the control of a control unit 16.

Contact b of the switch S is connected to the positive input+ of a comparator 17, the output of which is connected to the control unit 16. The negative input− of the comparator 17 is connected to a dynamic limit value former 18, the mode of operation of which is described hereinbelow. The control unit 16 is in turn connected to the control device 10, to which it can pass at least two operational signals, which are represented in diagrammatic form as "Test" and "Stop".

The output of the control device 10 passes the frequency of the motor $f_{motor}$ to the dynamic limit value former 18. The dynamic limit value former 18 has, in addition thereto, an input by means of which a user can input a factor F. An input device required for the purpose is not shown in greater detail.

The dynamic limit value former 18 is further connected to a computation device 19, which is connected to contact a of the switch S. The computation device 19 has an input into which it is possible to input two different frequency values $f_1$, $f_2$, symbolized by two arrows.

The elements 15 to 19 and the switch S form an evaluating device.

Before being put into operation for the first time, the pump arrangement 1 is put into a test mode, wherein the switch S connects the power ascertaining device 15 to contact a. The valve 4 is closed so that the pump 2 is operating without through-flow. The motor 5 is then driven at a first frequency $f_1$ and then at a second frequency $f_2$. In both cases, operation is of only short duration so that thermal overloading does not take place.

The user is still free to input a factor F into the dynamic limit value former 18. If he does not do that, a prespecified factor F is used, for example 1.2.

During the two test runs at the two frequencies $f_1$ and $f_2$, two powers are ascertained, namely $G_{f1}$ at frequency $f_1$ and $G_{f2}$ at frequency $f_2$. In a power/through-flow diagram having power on the ordinate, $G_{f1}$ and $G_{f2}$ correspond to the intercepts on the ordinate. From those two electrical powers there can then be ascertained a value $G_{fix}$, which not only reflects the power loss in the stator, rotor and inverter but basically includes all parasitic power consumption effects and power losses which do not directly contribute to the drive power of the pump 2.

That power $G_{fix}$ is ascertained in accordance with the following equation:

$$G_{fix} = \frac{G_{f_2} - G_{f_1}\left(\frac{f_2}{f_1}\right)^3}{1 - \left(\frac{f_2}{f_1}\right)^3}$$

The equation shows that the power $G_{fix}$ is dependent upon the third power of the ratio of the two frequencies. Advantageously, therefore, an adequate interval is selected between the frequencies; for example, frequency $f_1$ is made twice as large as frequency $f_2$.

Once that test has been carried out, the switch S is switched over and the value $G_{fix}$ can subsequently be used for the purpose of ascertaining the dynamic control quantity $G_x$, which is obtained from the following equation:

$$G_x = \left[(G_{f_1} - G_{fix}) \times \left(\frac{f_x}{f_1}\right)^3 + G_{fix}\right] \times F$$

For each motor frequency, therefore, a control quantity is ascertained and that control quantity is compared in the comparator 17 with the actual drive power of the motor $P_{act}$. If it is found that that power $P_{act}$ is less than the dynamic control quantity $G_x$, it is deduced that the pump is running without a load, that is to say the pump arrangement 1 is being operated without through-flow, or at least that the through-flow is too low. In such a case, the control unit 16 generates a "Stop" signal, by means of which the control device 10 and also, as a result, the converter 6 are stopped.

If it is ascertained during a number of consecutive scans that the through-flow is too low, factor F should be lowered slightly in order to allow further operation. However, a certain degree of discrimination is necessary in such a case because excessive lowering will prevent a malfunction from being detected.

Figure 2:
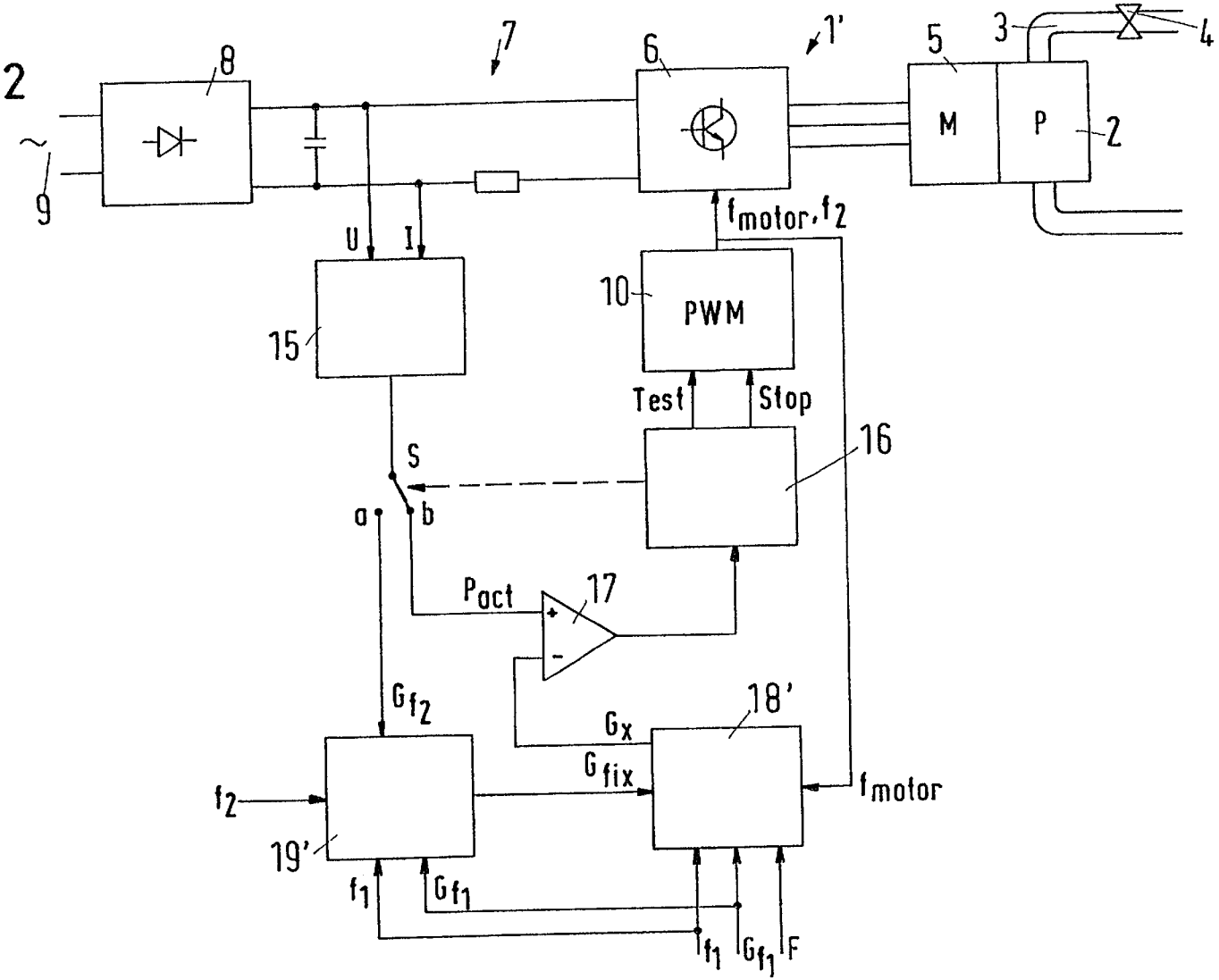
FIG. 2 shows a second embodiment of a pump arrangement.

FIG. 2 shows a modified embodiment, wherein identical parts are given identical reference symbols. Reference symbols of corresponding parts are provided with a prime.

In this embodiment, it is not necessary to carry out the test operation at two different frequencies. Instead, for a particular frequency $f_1$, a value $G_{f1}$ is specified for the power. The two values can be taken, for example, from a data sheet for the centrifugal pump 2. The two values $f_1$, $G_{f1}$ are fed into both the dynamic limit value former 18' and the computation device 19'. In testing, it is then merely necessary to carry out one test run; that is done at a frequency $f_2$ which can be selected virtually as desired, but must not be the same as frequency $f_1$. The remainder of the procedure is then the same as described with reference to FIG. 1.

In an embodiment which is not shown in graphic form, the evaluating device determines the basis and the control quantity entirely automatically. The test frequencies $f_1$ and $f_2$ are stored, from the time of manufacture, in the evaluating device, the test mode proceeding automatically once the valve has been closed and the factor has been inputted.

The invention is based on the motor frequency f. However, because the motor frequency and the motor speed of rotation n are linked by the known relationship $$n = \frac{f \cdot 60}{P}(1 - S)$$

(P: number of poles; S: slip)

for an asynchronous motor, the control quantity can, accordingly, also be formed as a function of the speed of rotation.

What is claimed is:

1. An electric motor for driving a pump, comprising:

control electronics for determining the frequency of rotational speed of the pump motor, a frequency sensor for detecting the frequency of the pump motor, a power sensor for detecting electrical power consumed by the pump motor, a computational device for calculating a threshold reference power level which would be present at a predetermined condition that would lead to a malfunction of the motor, for at least one frequency of the pump motor, a comparator that compares the electrical power actually consumed by the pump motor to the threshold reference power level, and a switch for disabling the pump motor when the comparator senses that the electrical power consumed by the pump motor is less than the threshold reference power level.

2. The apparatus of claim 1, wherein the computational device contains a second computational device for determining a fixed power loss of the pump motor.

3. The apparatus of claim 2, wherein the second computation device contains a converter for converting the fixed power loss into a threshold reference power level.

4. The apparatus of claim 2, wherein the fixed power loss is calculated from at least two measurements of the electrical power consumed by the motor at different frequencies and without flow through the pump, according to the following formula:

$$G_{fix} = \frac{G_{f2} - G_{f1} \times \left(\frac{f_2}{f_1}\right)^3}{1 - \left(\frac{f_2}{f_1}\right)^3},$$

wherein $G_{fix}$ is the fixed power loss, $f_1$ is the first frequency, $f_2$ is the second frequency, $G_{f1}$ is the power consumed by the motor at frequency $f_1$, and $G_{f2}$ is the power consumed by the motor at frequency $f_2$.

5. The apparatus of claim 3, wherein the calculated threshold reference power level includes a product, one of the factors of which can be specified by a user.

6. The apparatus of claim 5, wherein the factor is selected to be greater than unity.

7. The apparatus of claim 6, wherein the threshold reference power level is calculated according to the following formula:

$$G_x = \left[(G_{f1} - G_{fix}) \times \left(\frac{f_x}{f_1}\right)^3 + G_{fix}\right] \times F,$$

wherein $G_x$ is the threshold reference power level, F is the factor, $f_x$ is actual frequency of the motor, and the other quantities are as indicated above.

8. A method of controlling the operation of a pump driven by an electric motor comprising the steps of:

determining the frequency of rotational speed of the pump motor, detecting the frequency of the pump motor, detecting electrical power consumed by the pump motor, calculating a threshold reference power level which would be present at a predetermined condition that would lead to a malfunction of the motor, for at least one frequency of the pump motor, comparing the electrical power actually consumed by the pump motor to the threshold reference power level, and disabling the pump motor when the electrical power consumed by the pump motor is less than the threshold reference power level.

9. The method of claim 8, wherein the fixed power loss is calculated from at least two measurements of the electrical power consumed by the motor at different frequencies and without flow through the pump, according to the following formula:

$$G_{fix} = \frac{G_{f2} - G_{f1} \times \left(\frac{f_2}{f_1}\right)^3}{1 - \left(\frac{f_2}{f_1}\right)^3},$$

wherein $G_{fix}$ is the fixed power loss, $f_1$ is the first frequency, $f_2$ is the second frequency, $G_{f1}$ is the power consumed by the motor at frequency $f_1$, and $G_{f2}$ is the power consumed by the motor at frequency $f_2$.

10. The method of claim 9, wherein the calculated threshold reference power level includes a product, one of the factors of which can be specified by a user.

11. The method of claim 10, wherein the factor is selected to be greater than unity.

12. The method of claim 11, wherein the threshold reference power level is calculated according to the following formula:

$$G_x = \left[(G_{f1} - G_{fix}) \times \left(\frac{f_x}{f_1}\right)^3 + G_{fix}\right] \times F,$$

wherein $G_x$ is the threshold reference power level, F is the factor, $f_x$ is actual frequency of the motor, and the other quantities are as indicated above.

* * * * *